US006541901B2

(12) United States Patent
Gorog et al.

(10) Patent No.: US 6,541,901 B2
(45) Date of Patent: Apr. 1, 2003

(54) TENSION MASK FRAME ASSEMBLY FOR A CRT

(75) Inventors: Istvan Gorog, Lancaster, PA (US); Joey John Michalchuk, Lambertville, NJ (US); Richard William Nosker, Princeton, NJ (US); Philip Michael Heyman, West Windsor, NJ (US)

(73) Assignee: Thomson Licensing S.A., Boulogne Cedex (FR)

( * ) Notice: Subject to any disclaimer, the term of this patent is extended or adjusted under 35 U.S.C. 154(b) by 138 days.

(21) Appl. No.: 09/793,639

(22) Filed: Feb. 26, 2001

(65) Prior Publication Data

US 2002/0117956 A1 Aug. 29, 2002

(51) Int. Cl.[7] ..... H01J 29/80
(52) U.S. Cl. ..... 313/407; 313/403
(58) Field of Search ..... 313/407, 403, 313/408, 402, 404, 405, 406

(56) References Cited

U.S. PATENT DOCUMENTS 5,625,251 A 4/1997 Nosker et al. ..... 313/403
5,646,478 A 7/1997 Nosker et al. ..... 313/402
6,111,347 A * 8/2000 Kwak ..... 313/402
6,157,121 A 12/2000 Ragland, Jr. et al. ..... 313/403
6,232,710 B1 * 5/2001 Tanaka ..... 313/404
6,388,369 B1 * 5/2002 Lee ..... 313/407

* cited by examiner

*Primary Examiner*—Ashok Patel
(74) *Attorney, Agent, or Firm*—Joseph S. Tripoli; Joseph J. Laks; Carlos M. Herrera

(57) ABSTRACT

A tension mask frame assembly for a color cathode-ray-tube including a frame having four respective sides, two of the sides paralleling each other and having insert receiving brackets for supporting strand termination inserts therein and vertical mask strands welded to said termination inserts. The strands have a plurality of cross-wires extending perpendicular to the strands and attached thereto by a conductive bonding material. The wires and termination inserts are composed of materials having a first coefficient of thermal expansion. The frame and receiving brackets are composed of materials having a second coefficient of thermal expansion. The termination inserts thermally expand and contract independently of the frame and receiving brackets, whereby movement of the strands in the horizontal dimension is controlled by thermal expansion and contraction of the termination inserts and cross-wires.

7 Claims, 2 Drawing Sheets

TENSION MASK FRAME ASSEMBLY FOR A CRT

The present invention relates to color cathode-ray-tube (CRT) and, more particularly, a tension mask frame assembly having improved microphonics and thermal expansion behavior.

BACKGROUND OF THE INVENTION

A conventional shadow mask type color CRT generally comprises an electron gun for forming and directing three electron beams to a screen of the CRT. The screen is located on the inner surface of the faceplate of the tube and is made up of an array of elements of three different color-emitting phosphors. The shadow mask is interposed between the gun and the screen to permit each electron beam to strike only the phosphor elements associated with that beam. In a majority of CRTs, the shadow mask is a domed thin sheet of metal capable of self-maintaining its configuration with the inner surface of the CRT faceplate and is supported by a mask frame. The mask acts as a parallax barrier that shadows the screen and permits the transmitted portions of the electron beams to excite phosphor elements of the correct emissive color on the CRT screen. Localized heating causes a doming-type deformation, which moves the mask apertures in relation to the fixed phosphor stripes thereby distorting the paths of the electron beams passing through the apertures between the strands, effecting misregister with the phosphor elements. Another type of mask commonly used in CRTs is referred to as a strand tension mask comprising a plurality of spaced apart thin parallel strands attached to a rigid mask frame. Such thin strands are basically non-self-supporting so they must be held in high tension so that tension is not lost when the mask expands thermally during operation. The tension on the strands ensures that the apertures formed between the strands remain in alignment with the phosphor elements on the screen. In these tension masks, even though localized thermal expansion of the strands is compensated by the tensioning of the strands, thermal expansion during tube operation can still cause the mask strands to move in relation to the fixed phosphor stripes thereby distorting the paths of the electron beams passing through the apertures between the strands, effecting misregister with the phosphor elements with resulting picture distortion.

Strand tension masks also have an inherent susceptibility to external vibration. Under tension, the strands tend to vibrate independently at a fundamental natural frequency. External influences such as the impact of the electron beam scan rates, mechanical shock, and vibration induced by a nearby loudspeaker or other sources of noises can stimulate large amplitude modes which can actively distort picture quality. Strand vibration can be damped by frictionally contacting each of the strands with a cross-wire attached to the mask frame. However, relying on cross-wires to provide positive and uniform contact on the strands is difficult to attain particularly when the associated strand mask is flat rather than curved.

Because of the negative effects of external vibrations, thermal expansion, and increased bulk and weight of the frame necessary for bearing the tensional strength of the strands, mask structures formed of light weight structures with low coefficients of thermal expansion are desirable. Thus, high cost iron-nickel alloy such as INVAR® is preferred over the low cost, low carbon alloy steel, since iron-nickel alloy materials have relatively low coefficient of thermal expansions (CTEs) as compared to low carbon alloy steels. Although such a structure is attractive from a performance standpoint, system costs are prohibitive from a manufacturing standpoint.

Hence, a need exists for a tension mask structure that overcomes the drawbacks of the prior art structure in maintaining a relatively precise spacing of the mask strands during manufacturing and tube operation.

SUMMARY OF THE INVENTION

The present invention provides a mask frame assembly having a plurality of spaced apart parallel strands. Each of the metal strands are attached at their ends to a strand termination insert having a lower coefficient of thermal expansion than the strands. The strand termination inserts are supported within insert receiving brackets located at two opposing sides of the mask frame. The mask also includes a plurality of cross-wires oriented substantially perpendicular to the strands. The cross-wires are attached to the strands and have similar coefficient of thermal expansion as the strand termination inserts.

DETAILED DESCRIPTION

Figure 1:
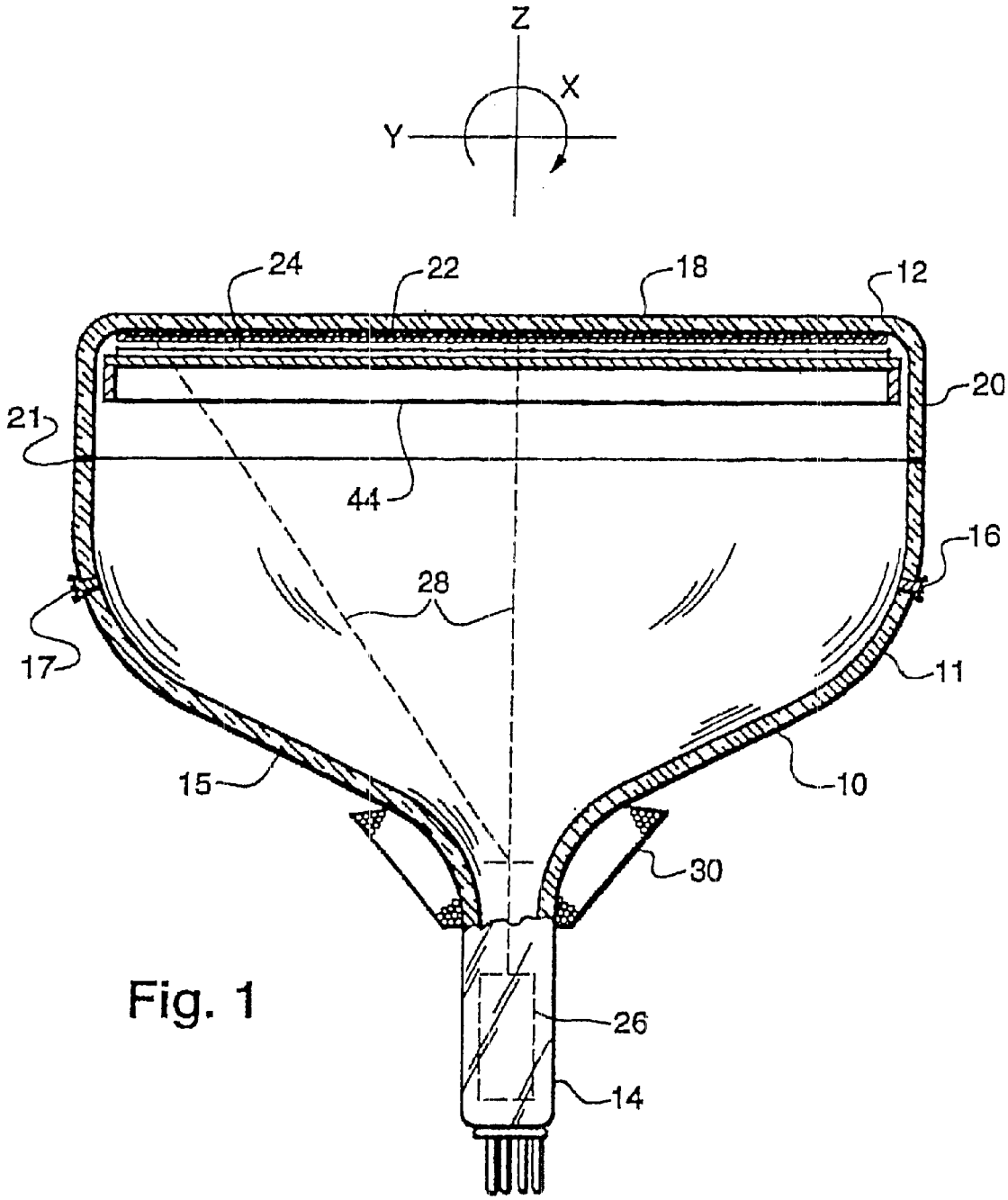
FIG. 1 is a side view, partially in the axial section, of a color picture tube, including a tension mask assembly according to the present invention.

FIG. 1 shows a conventional cathode ray tube 10 having a glass envelope 11 comprises a rectangular faceplate panel 12 and a tubular neck 14 connected by a rectangular funnel 15. An internal conductive coating (not shown) on the funnel 15 extends from an anode button 17 to a neck 14. The panel 12 comprises a viewing faceplate 18 and a peripheral flange or sidewall 20 that is sealed to the funnel 15 by a glass frit 21. A three-color phosphor screen 22 (microstructure not shown) is carried by the inner surface of the faceplate 18. The screen 22 is a line screen with the phosphor lines arranged in triads, each triad including a phosphor line pattern of each of the three colors. The phosphor lines approximately parallel a minor axis, Y, of the tube. A strand tension mask assembly 24 is removably mounted in a predetermined spaced relation to the screen 22. An electron gun 32, shown schematically by dashed lines in FIG. 1, is centrally mounted within the neck 14 to generate three in-line electron beams, a center beam and two side or outer beams, along convergent paths through the strand tension mask assembly 24 to the screen 22.

The tube 10 is designed to be used with an external magnetic deflection yoke, such as the yoke 30 shown in the neighborhood of the funnel to neck junction. When activated, the yoke 30 subjects the three beams to magnetic fields causing the beams to scan horizontally and vertically in a rectangular raster over the screen 22.

Figure 2:
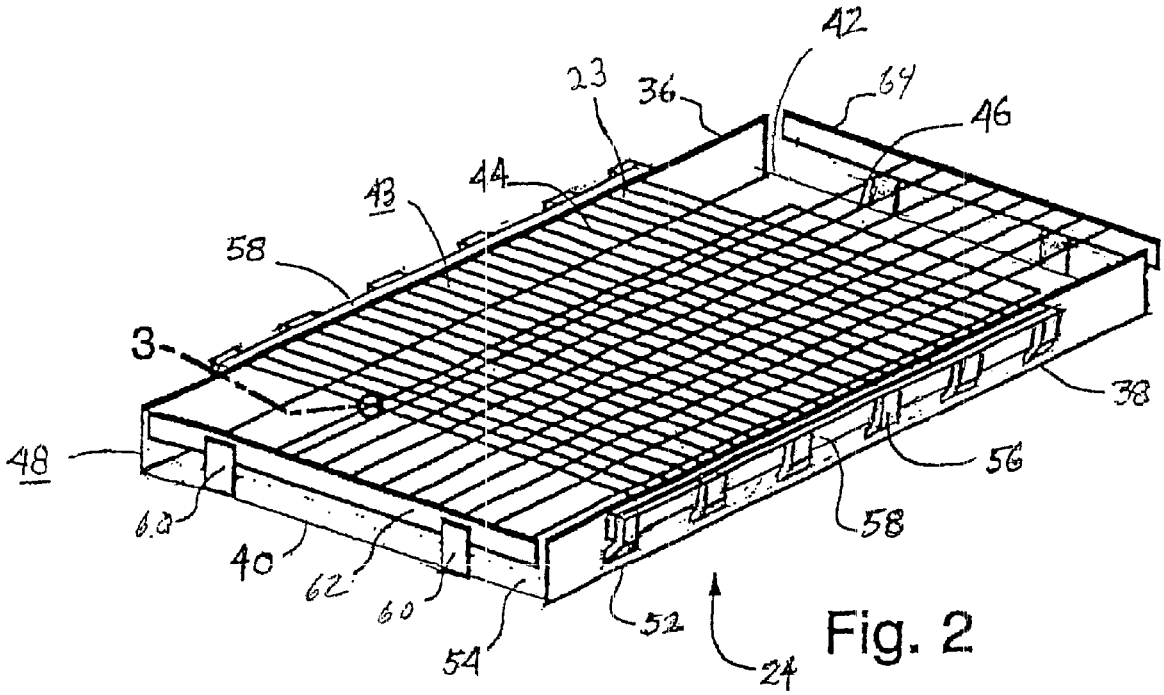
FIG. 2 is a perspective view of the tension mask assembly in the tube of FIG. 1.

The strand tension mask assembly 24, shown in greater detail in FIG. 2, includes two long sides 36 and 38 and two short sides 40 and 42. The two long sides 36 and 38 of the mask substantially parallel the major axis, X, of the tube and the two short sides 40 and 42, parallel the minor axis, Y, of the tube. The strand tension mask 23 is made, preferably, from a thin rectangular sheet of about 0.05 mm (2 mil) thick low carbon steel. The sheet is etched into a plurality of elongated vertical strands 44 that are substantially parallel to the minor axis, Y, and each having a transverse dimension, or width, of about 0.55 mm (21.5 mils) separated by substantially equally spaced slots, each having a width of about 0.11 mm (5.5 mils), that approximately parallel the minor axis, Y, of the CRT.

Figure 3:
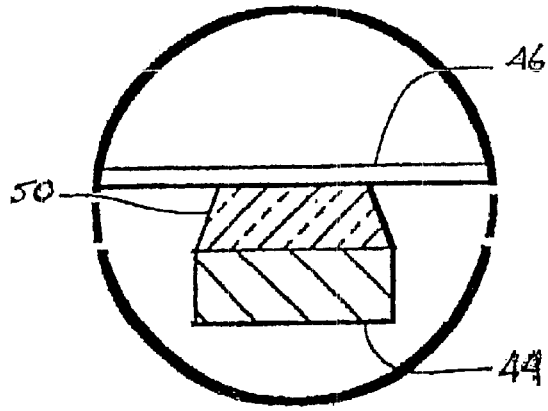
FIG. 3 is an isolated view of a strand in cross-section, and a cross-wire taken at circle 3 in FIG. 2.

The strand tension mask 23 further comprises a plurality of cross-wires 46 each having a diameter of about 0.025 mm (1 mil), are disposed substantially perpendicular to the strands 44. The preferred material for the cross-wires 46 is INVAR® (TM Reg. #63,970) wire or any other similar materials having a low coefficient of thermal expansion. In the completed tension mask assembly 24, the strands 44 and cross-wires 46 are both electrically connected to the anode button 17. In the preferred embodiment, cross-wires 46 bonded to the strands 44 by an adhesive 50, as shown in FIG. 3. The strands 44 are generally flat and have a screen-facing side and a gun-facing side. The cross-wires 46 lie on the screen-facing side of the strands 44.

A mask frame 48 for supporting the strand tension mask 23 is shown in FIG. 2. The mask frame 48 comprises two cantilevers 52 attached to a peripheral bottom segment 54, and a plurality of insert receiving brackets 56 attached to the cantilevers 52. The strand tension mask 23 comprises a pair of strand termination inserts 58 capable of being fitted into the recesses formed between the receiving brackets 56 and mask frame cantilevers 52 of the mask frame 48. The plurality of strands 44 are connected to the terminating inserts 58 and are held in tension between the long sides 36 and 38 when the terminating inserts 58 are installed within the receiving brackets 56. The strand termination inserts 58 are held such that they can expand and contract along the major axis, X, independently of the cantilevers 52 and the receiving brackets 56. The strand termination inserts 58 are formed from a material having low coefficient of thermal expansion similar to that of the cross-wires 46. The preferred material for the strand termination inserts 58 is Invar (TM Reg. #63,970) or any other similar materials having a low coefficient of thermal expansion.

Connected to the short sides 40 and 42, by brackets 60, are two cross-wire termination bars 62 and 64, respectively. The two termination bars 62 and 64 are parallel to the short sides 40 and 42. The plurality of cross-wires 46 are connected to and extend between the two termination bars 62 and 64, with brackets 60 applying a slight tension on the cross-wires 46. As mentioned earlier, the cross-wires 46 are bonded to the strands 44, to provide positive and uniform contact of the cross-wires 46 with the strands of the mask. The cross-wires 46, effectively dampen strand vibration by their contact with the brackets 60 of the mask. A further benefit lies in the fact that the cross-wires 46 connect each strand to one another permitting the use of dampening means along the periphery of the strand tension mask. More particularly, as another possible construction of the strand tension mask 23, the cross-wires 46 are terminated at the outer most strand of the mask thereby eliminating the cross-wire termination bars 62 and 64. A vibration damping means (not shown) is secured to the periphery of the strand tension mask 23. The dampening means functions to dampen the entire mask since each strand 44 is interconnected by the cross-wires 46.

As the tension mask assembly is heated during operation or manufacturing of the CRT, the strand termination insert 56 will be carried along the Y axis in accordance with the deflection of the mask frame 48 but will expand along the X axis of the CRT free from any mask frame deflection. Therefore, strand 44 motion in the X direction, horizontal dimension, predominantly depends on the expansion and contraction of the strand termination inserts 58 and the cross-wires 46; consequently, the expansion of the array of mask strands in the horizontal dimension will be controlled by the CTE of the iron-nickel alloy material, which is 9–30×10–7/° C., as opposed to the CTE of the disfavored low carbon alloy steels, which have CTEs in the range of 120 to $160\times10^{-7}$/° C.

Strand tension mask 23 is made from a flat mask 43 which comprises a thin flat sheet of low carbon steel etched into a plurality of strands 44. The flat mask 43 is fitted onto the mask frame 48 by positioning the flat mask 43 such that the strands 44 of the flat mask 43 are aligned to the strand termination inserts 58.

Prior to the attachment of the flat mask 43 to the strand termination inserts 58, the cantilevers 52 which house the strand termination inserts 58 are compressed inward through force applied to the receiving brackets 56. The strands 44 are attached to the strand termination insert 58, wherein the strands 44 may be attached by welding or chemical bonding. Next, the force is removed from the receiving brackets 56 and the cantilevers 52 move back to their original positions, thereby tensioning the strands 44.

In the preferred embodiment, the screen-side of the strands 44 is coated with a permanent conductive bonding material 50. A plurality of cross-wires 46 is applied by winding or some other suitable technique onto the strands 44 and then the adhesive is cured. In the preferred embodiment, the cross-wires 46 are a iron-nickel alloy and the strands 44 are a steel alloy. The cross-wires 46 lie across the strands 44 substantially perpendicular to the strands 44 and equidistantly spaced from each other.

As the embodiments that incorporate the teachings of the present invention have been shown and described in detail, those skilled in the art can readily devise many other varied embodiments that still incorporate these teachings without departing from the spirit of the invention.

What is claimed is:

1. A tension mask frame assembly for a cathode-ray-tube comprising:

a mask frame;

at least one support bracket attached to each opposing sides of said frame;

a plurality of spaced apart parallel strands having a first coefficient of thermal expansion, each end of said strands being attached to opposed strand termination inserts having a second coefficient of thermal expansion and being located within said brackets; and, a plurality of cross-wires oriented substantially perpendicular to said strands, said cross-wires attached to said strands and having a coefficient of thermal expansion similar to said second coefficient of thermal expansion.

2. The tension mask frame assembly of claim 1, further comprising cross-wire termination bars, said cross-wire termination bars attached to opposed ends of said frame and substantially perpendicular to said strand termination bars for connecting the ends of said cross-wires.

3. The tension mask frame assembly of claim 1, wherein said mask frame and said at least one support bracket have a coefficient of thermal expansion similar to said first coefficient of thermal expansion.

4. A tension mask frame assembly for a CRT comprising a faceplate panel having a luminescent screen with phosphor patterns on an interior surface thereof, comprising:

a mask frame;

a pair of spaced apart strand termination inserts, each of said termination inserts mountable by at least one selected point to opposed sides of said mask frame and having a coefficient of thermal expansion causing at least a portion thereof to move through a temperature induced path relative to said frame;

a plurality of spaced apart strands forming a plurality of uniformly spaced slot registered with the phosphor lines of the CRT and attached to said strand termination inserts;

a plurality of cross-wires having a coefficient of thermal expansion similar to said strand termination inserts, said cross-wires oriented substantially perpendicular and connected to said strands to form a continuous strand mask, said strand mask being responsive to said at least a portion of said movement of said temperature induced path to maintain relative positions for continued sequential alignment of said slots with said phosphor pattern.

5. The tension mask frame assembly of claim 4, wherein said strand termination inserts and cross-wires have similar coefficient of thermal expansion.

6. The tension mask frame assembly of claim 4, wherein said strand termination inserts and cross-wires have coefficient of thermal expansion at least approximately an order of magnitude greater than the coefficient of expansion of said mask frame.

7. The tension mask frame assembly of claim 4, wherein said at least one selected point comprises an insert receiving bracket adapted for supporting said strand termination inserts.

* * * * *